US007976680B2

(12) United States Patent
Drefs et al.

(10) Patent No.: US 7,976,680 B2
(45) Date of Patent: Jul. 12, 2011

(54) ROPE GUIDE ARRANGEMENT

(75) Inventors: Wolfgang Drefs, Huettlingen (DE); Sylvain Demers, Aalen (DE); Josef Schneid, Vogt (DE)

(73) Assignee: Voith Patent GmbH, Heidenheim (DE)

( * ) Notice: Subject to any disclaimer, the term of this patent is extended or adjusted under 35 U.S.C. 154(b) by 538 days.

(21) Appl. No.: 12/115,903

(22) Filed: May 6, 2008

(65) Prior Publication Data

US 2008/0302499 A1 Dec. 11, 2008

(30) Foreign Application Priority Data

May 18, 2007 (DE) ..... 10 2007 023 216

(51) Int. Cl.
*D21F 1/40* (2006.01)

(52) U.S. Cl. ..... 162/193; 226/92; 34/120

(58) Field of Classification Search ..... 162/193, 162/194, 255; 226/92; 34/120
See application file for complete search history.

(56) References Cited

U.S. PATENT DOCUMENTS 2,716,291 A * 8/1955 Daly, Jr. ..... 34/120
5,257,465 A * 11/1993 Marx, Jr. ..... 34/60
5,837,101 A * 11/1998 Ilvespaa et al. ..... 162/255

FOREIGN PATENT DOCUMENTS

DE 696 08 658 2/2001
EP 1580319 * 3/2005

OTHER PUBLICATIONS

EP 1580319, EPO Machine Translation to English language, retrieved Oct. 18, 2010.*

* cited by examiner

*Primary Examiner* — Eric Hug
(74) *Attorney, Agent, or Firm* — Greenblum & Bernstein, P.L.C.

(57) ABSTRACT

Rope guide arrangement, deflection device, and method for guiding a leader strip of a material web through a device. The arrangement includes at least two ropes being arranged offset relative to one another in a first plane defined by a machine direction and a transverse machine direction. Further, the at least two ropes are arranged offset relative to one another in a second plane oriented at a non-zero angle from the first plane.

27 Claims, 3 Drawing Sheets

ROPE GUIDE ARRANGEMENT

CROSS-REFERENCE TO RELATED APPLICATIONS

The present application claims priority under 35 U.S.C. §119 of German Patent Application No. 10 2007 023 216.2 filed May 18, 2007, the disclosure of which is expressly incorporated by reference herein in its entirety

BACKGROUND OF THE INVENTION

1. Field of the Invention

The invention relates to a rope guide arrangement for guiding a leader strip of a material web through a processing device having a machine direction and a transverse machine direction. The arrangement includes at least two ropes arranged offset relative to one another in a first plane defined by the machine direction and the transverse machine direction.

2. Discussion of Background Information

Within the course of its manufacture, a paper web must be guided through several processing devices, for example, a press section, a drying section, a calender, a coating device, a size press or the like. A rope guide arrangement is often used for this purpose, which forms a rope nip at the beginning of a processing device. Ropes from different directions are brought together in this rope nip. A strip that has been cut with a width of approximately 20-30 cm at the edge of the paper web is guided into the rope nip formed by ropes converging to hold the leader strip in a clamping manner and to guide the leader strip along the web travel path running through the processing device. When the leader strip has been guided through the processing device and a tensile force can be exerted on the leader strip after the processing device in the web travel direction, the paper web will be cut to width so that it then runs through the processing device in its full width.

The direction in which the material web runs through the processing device is usually called the "machine direction." A direction perpendicular thereto is called the "transverse (crosswise) machine direction."

A rope guide arrangement of the type mentioned at the outset is known, e.g., from DE 696 08 658 T2. According to this arrangement, two ropes are arranged in a plane stretching through the machine direction and the transverse machine direction. Thus, the ropes run parallel to a plane in which the material web later moves.

Usually, two or three ropes are used. In the case of two ropes, the inside rope, i.e., the rope facing or adjacent the processing device lies, e.g., below the leader strip, and the other rope lies above the leader strip. In the case of three ropes, the two outer ropes lie, e.g., below the leader strip and the center rope lies above the leader strip. However, the arrangement can also be reversed. More than three ropes can also be used.

Although the threading operation for a material web has by now become a standard operation, the leader strip often tears, even if the threading process is carried out carefully. This situation can also occur after the leader strip has left the rope guide arrangement, results in a repetition of the threading process and an associated a loss of time. This lost time is not available for the actual production.

SUMMARY OF THE INVENTION

The invention keeps the time for threading the material web short.

According to the invention, a rope guide arrangement of the type mentioned at the outset includes ropes arranged offset relative to one another in a second plane that forms an angle with the first plane.

The double offset of the ropes can be maintained over at least major parts of the transfer section, and preferably over the entire transfer section. Moreover, the double offset of the ropes can be maintained on head wheels and guide rolls that can be wrapped around from above or from below. The problems that sometimes occur while threading a material web are attributed to the fact that the leader strip is heavily loaded between the ropes when the ropes lie next to one another in the plane of the material web or parallel thereto. The load is particularly marked where the ropes are sharply deflected, e.g., with guide rolls and their rope pulleys or rope support sections. When the leader strip is heavily loaded, edge tears on the strip edge or also bursts within the leader strip can occur. The edge tears preferably occur at the point where the leader strip runs out of the ropes at an angle to the travel direction, namely where the leader strip is pressed downwards around a lower rope by a rope lying above it. A particularly high tensile stress may occur at this point due to the curvature or bending of the "rope/strip profile." If, for example, a "rope/strip profile" approximately 8 mm high is guided over a deflection with a 300 mm radius, an additional linear extensional strain of 2.7% results through the curvature on the sections of the leader strip located above the ropes. With certain material webs, this strain already leads to breakage. Although the thickness of the "rope/strip profile" can be reduced with the use of thinner ropes, such ropes increase the risk of cutting the leader strip.

If the ropes are additionally offset relative to one another in the second plane, a lower tensile stress occurs in the strip edge with the same radius of curvature. The rope diameter can be increased with no adverse impact on the bending height of the "rope/strip profile." In this arrangement, the load on the leader strip can be reduced, and the risk of edge tears occurring may also be reduced. A leader strip having less damage can be guided through the processing device as a whole with fewer disturbances so that a considerable time gain can be achieved.

Preferably, the ropes may be guided over deflection devices with a rope placement area having a contour with different radii parallel to a deflection axis. The ropes follow the web travel path through the processing device. In the processing device, the material web is generally deflected several times. For instance, a deflection occurs at each guide roll in a calender. Accordingly, the ropes are guided over head wheels or rope pulleys having axes forming deflection axes that correspond to the axes of the deflection rolls. While the ropes were previously guided in a common groove, according to the invention, a profile is contoured to have points of different depths and different heights parallel to the deflection axis. Through the different radii of contour, the ropes can be arranged in different positions from the outset. Moreover, when corresponding contours are provided on adjacent deflection devices, the ropes may also guided between the deflection devices with the double offset.

Preferably, the contour may have at least one rope groove to accommodate one rope and a larger radius to accommodate another rope axially outside the rope groove. Thus, the two ropes can be offset relative to one another in the radial direction based on the deflection direction. Because one rope is arranged in the rope groove and the other axially adjacent outside the rope groove, the offset results in the axial direction of the deflection device.

It may be preferable for at least one inclined plane to be arranged in the axial direction next to the rope groove, and the inclined plane may be tilted in the direction toward the rope groove. The rope located in the rope groove is virtually fixed in the radial and in the axial direction. The other rope can slide on the inclined plane. Since the inclined plane is tilted towards the rope groove, the rope placed there will slide in the direction of the rope groove until it bears against the other rope, or more particularly clamps the leader strip against the other rope. The rope located in the rope groove can project somewhat radially out of the rope groove. In this placement area, the leader strip can then be held in a clamping manner.

Preferably, the inclined plane has a tilt angle to the deflection axis in a range of 5° to 15°. The inclined plane forms a section having a conical circumferential surface with a conical angle of 10° to 30°. Thus, the inclined plane is tilted at a relatively shallow angle, so that, although the rope located on the inclined plane slips towards the rope located in the rope groove under the occurring stress to firmly hold or clamp the leader strip, it is not possible for the rope located outside the rope groove to be stuck in any way such that it could be released again only with effort without greater action of forces.

In an alternative embodiment, two rope grooves, arranged next to one another in the axial direction, can be separated from one another by a peripheral radial projection. A rope may be arranged in each rope groove, while a third rope may be arranged in a recess embodied or formed between the ropes arranged in the rope grooves. The two ropes arranged in the rope grooves may project somewhat out of the rope grooves here too. A recess or a "valley" between the two ropes can be formed and the third rope can be arranged in the recess. The third rope then bears against the two other ropes, thus forming a clamping area to hold the leader strip.

Preferably, at least one rope groove is curved more on its axial side facing towards the projection than on its axial side facing away from the projection. The rope groove is thus structured asymmetrically in the axial direction. This has the advantage that although the rope arranged between the two ropes in the rope grooves can press the ropes arranged in the rope groves axially outwards a little in order to increase the clamping force, a movement of the ropes located in the rope grooves towards one another is impeded.

It is hereby preferred for the projection to have a smaller radial extension than an axially outer limit of at least one rope groove. The deflection device can thus be produced easily. The radial projection can be produced together with the production of the rope grooves, as it were, without any additional material being necessary.

Preferably, at least two ropes have different diameters. This provides further optimization possibilities, e.g. in the difference in the rotational speeds of the ropes. Wear can be kept low.

It is hereby preferred for three ropes to be provided, two of which have a same diameter and the third of which has a different diameter. A favorable bending of the leader strip can thus be achieved.

The present invention is directed to a rope guide arrangement for guiding a leader strip of a material web through a device. The arrangement includes at least two ropes being arranged offset relative to one another in a first plane defined by a machine direction and a transverse machine direction. Further, the at least two ropes are arranged offset relative to one another in a second plane oriented at a non-zero angle from the first plane.

In accordance with a feature of the instant invention, the arrangement can also include at least one deflection device including a rope placement area having a contour with different radii parallel to a deflection axis. The at least two ropes can be guidable over the at least one deflection device. The contour may include at least one rope groove and at least one surface axially outside of the at least one rope groove having a larger radius than the at least one rope groove, and one of the at least two ropes may be positionable in the at least one rope groove, and another of the at least two ropes may be positionable on the at least one larger radius surface. The contour may also include at least one rope groove and at least one inclined plane arranged next to the rope groove in an axial direction of the at least one deflection device, and the at least one inclined plane can be tilted in a direction towards the rope groove. The inclined plane may have a tilt angle relative to the deflection axis in a range of 5° to 15°.

According to another feature of the invention, the contour may include at least two rope grooves arranged next to one another in an axial direction of the at least one deflection device, and a peripheral radial projection arranged to separate the least two rope grooves from each other. The at least two ropes may include three ropes and the at least two rope grooves can include two rope grooves, such that a respective rope can be positionable in each rope groove and another rope can be positionable in a recess formed between the respective ropes arranged in the two rope grooves. The another rope may be positionable to face the peripheral radial projection. At least one of the at least two rope grooves may be curved more on an axial side facing the peripheral radial projection than on an axial side facing away from the peripheral radial projection. Further, a radial extension of the peripheral radial projection does not extend beyond a radial extension of an axially outer limit of at least one rope groove facing away from the peripheral radial projection.

In accordance with another feature of the invention, the at least two ropes may have different diameters. The at least two ropes can include three ropes, and a first and second of the three ropes can have a same diameter, while a third of the three ropes may have a different diameter.

The invention is directed to a deflection device for a rope guide in a material web production machine. The deflection device includes a rope placement area having a contoured surface in an axial direction. The contoured surface includes at least one rope groove and a structure adjacent the least one rope groove. The contoured surface is structured and arranged create a clamping force between a first rope positionable in the at least one rope groove and a second rope positionable to face the structure.

According to a feature of the present invention, the structure adjacent the at least one rope groove may include at least one inclined plane.

In accordance with another feature of the invention, the at least one rope groove may include two rope grooves and the structure adjacent the at least one rope groove may include a peripheral radial projection separating the two rope grooves.

The contoured surface can be structured and arranged to maintain a positioning between the first and second ropes in which the ropes are offset relative to each other in the axial direction and in a radial direction of the deflection device.

The invention is directed to a method of guiding a leader strip of a material web through a device. The method includes clamping the leader strip between at least two ropes arranged to be offset relative to one another in a first plane defined by a machine direction and a transverse machine direction and to be offset relative to one another in a second plane oriented at a non-zero angle from the first plane, and guiding the leader strip through the device.

According to a feature of the invention, the method can further include guiding the at least two ropes over a deflection device while maintaining the clamping of the leader strip. The deflection device may include at least one rope groove and at least one surface axially outside of the at least one rope groove, and the method can further include positioning a first rope of the at least two ropes in the at least one rope groove and positioning a second rope on the at least one surface axially outside of the at least one rope groove. The at least one surface axially outside of the at least one rope groove can be arranged to force the second rope toward the first rope.

In accordance with still yet another feature of the present invention, the deflection device can include at least two rope grooves separated by a peripheral radial projection, and the method may further include positioning a first rope of the at least two ropes in a first of the at least two rope grooves, positioning a second rope of the at least two ropes in a second of the at least two rope grooves, and positioning a third rope of the at least two ropes to face the peripheral radial projection. In this manner, the third rope can be forced against both the first and second ropes.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The invention is described below based on a material web, e.g., a paper, but it is understood that the arrangement can be utilized for other purposes.

Figure 1:
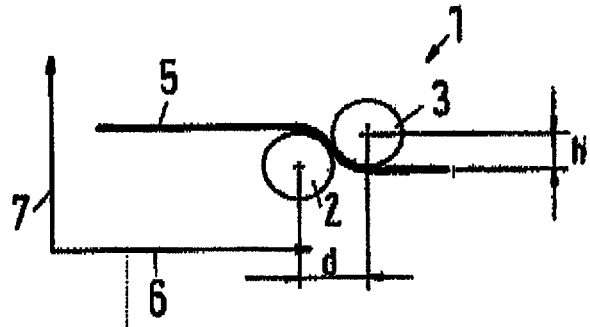
FIG. 1 diagrammatically illustrates a first embodiment of a rope guide with two ropes.

FIG. 1 shows in a very diagrammatic representation the principle of a rope guide arrangement 1 with two ropes 2 and 3. Ropes 2 and 3 are guided in a manner known per se parallel to a web travel path through a processing device (not shown in further detail) and clamp a leader strip 5, cut from the edge area of a material web, between them. Leader strip 5 usually has a width in the order of magnitude of 200-300 mm.

A first plane 6 of the processing device, which can extend in a machine direction and a transverse (crosswise) machine direction, is shown in FIG. 1. The machine direction is the direction in which the material web runs through the processing device. The transverse machine direction is basically the width direction of the material web. Since the material web as a rule changes its direction of movement in the processing device several times, the machine direction here is always to be seen only by section. Based on the representation in FIG. 1, the machine direction runs perpendicular to the drawing plane, and the transverse machine direction runs from left to right.

FIG. 1 shows a second plane 7 which runs perpendicular to the first plane 6. However, it is further noted that plane 7 can be arranged relative to plane 6 to form an angle different from 90°.

Ropes 2 and 3 (shown in a cross-sectional representation) can be arranged to be offset relative to one another in plane 6 by an offset d. In the known art, offset d was as large as the sum of the two radii of the ropes 2 and 3. Thus, in accordance with the invention, offset d is somewhat smaller than in the known art.

Ropes 2 and 3 are also offset relative to one another in second plane 7 by an offset h. As shown in FIG. 1, offset d and offset h are determined relative to the center lines of ropes 2 and 3.

In the exemplary embodiment of FIG. 1, offset h in second plane 7 can be selected such that leader strip 5 does not have to be bent around an entire height of lower rope 2, but only over, e.g., half its height. As a result, leader strip 5 will be deformed to a lesser extent. In particular, when rope guide arrangement 1 has to be deflected, for example, in the area of a deflection roller, the length difference between a left part of the leader strip 5 (based on FIG. 1) and the right part, which projects to the right below rope 3, is much smaller, so that a lower tensile stress is produced in leader strip 5. An optimum of clamping force and load on the strip can be adjusted through the selection of the size of offset h. This optimum can also be selected taking into account the quality of the material web.

Figure 2:
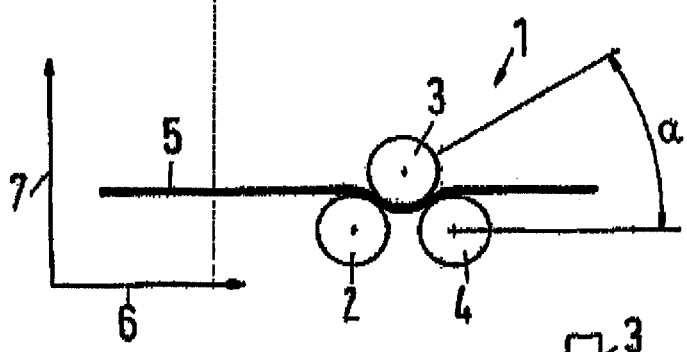
FIG. 2 illustrates a second embodiment of a rope guide with three ropes.

In the embodiment according to FIG. 2, three ropes 2-4 are arranged such that rope 3 is located not only between ropes 2 and 4 but also above them. Rope 3 is therefore offset in second plane 7 relative to ropes 2 and 4. Further, all three ropes are offset relative to one another in first plane 6, which produces an offset angle a between two legs. One of the legs is formed by the connection of the center points of ropes 2 and 4, while the other leg is formed by the connection of the center points of ropes 2 and 3. An optimum of clamping force and load on the strip can also be adjusted according to the quality of the material web through selection of the offset angle $\alpha$. It is also discernible that in this configuration of rope guide arrangement 1, leader strip 5 is likewise deformed less than with the previously known configurations in which ropes 2-4 lay were arranged in a same or common plane.

Figure 3:
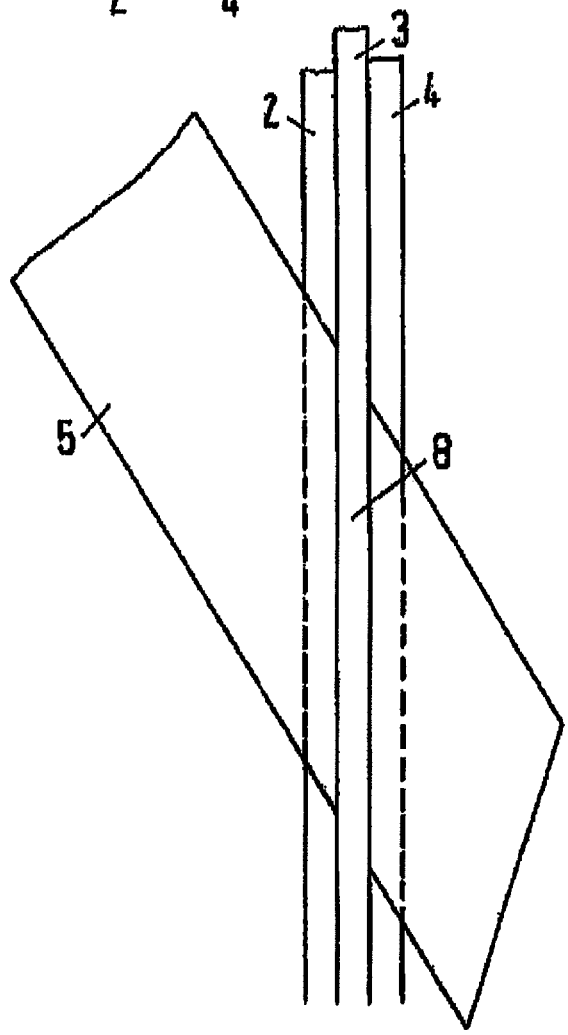
FIG. 3 illustrates a plan view of the rope guide with three sides.
Figure 4:
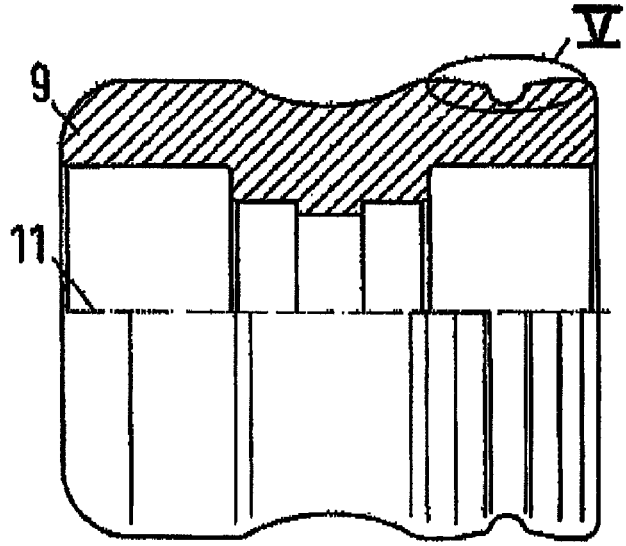
FIG. 4 illustrates a first embodiment of a rope pulley on a deflection roller.

FIG. 3, which shows a plan view of rope guide arrangement 1' according to FIG. 2, shows that rope 3 can be arranged to slightly overlap ropes 2 and 4. Thus, a deformation of leader strip 5 in clamping area 8 is kept low, so that the danger of overloading leader strip 5 can be kept low.

In order to render possible the guiding of ropes 2 and 3 according to FIG. 1 or the guiding of the ropes 2-4 according to FIG. 2, such that an offset of ropes 2-4 in two planes can be maintained in a transfer section, suitable deflection devices can be available at both ends of the transfer section. A first embodiment of a deflection device of this type, e.g., a rope pulley 9, is shown in FIGS. 4 through 6*e*. Rope pulley 9 can be structured for three ropes, as shown in FIGS. 6*a*-6*e*.

Figure 5:
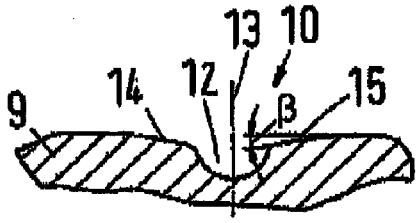
FIG. 5 illustrates an enlarged section V depicted in FIG. 4.

Rope pulley 9 has a rope placement area 10, which is shown in greater detail in FIG. 5. It is discernible that the rope placement area 10 has a contoured surface, and that the contoured surface includes contours having different radii parallel to a deflection axis 11.

In rope placement area 10, rope pulley 9 has a rope groove 12, in which the smallest radius of the rope placement area is located in a center 13. On both sides of rope groove 12, an inclined plane 14 and 15, i.e., a section of a conical circumferential surface, is arranged to axially adjoin rope groove 12. Inclined plane 14 and 15 has a tilt angle β in the order of magnitude from 5° to 15°, and in the present exemplary embodiment, approximately 10°.

If three ropes are now arranged on rope placement area 10, as shown in FIG. 6, center rope 3 can be located in rope groove 12, while outer ropes 2 and 4 are located on inclined planes 14 and 15. Due to the tensile force exerted on ropes 2 and 4, they slide downwards on inclined planes 14 and 15, i.e., towards rope groove 12, until they come to rest on center rope 3, i.e., to clamp leader strip 5. Further, a clamping force can be adjusted within certain limits through the selection of tilt angle β of inclined planes 14 and 15.

Figure 6A:
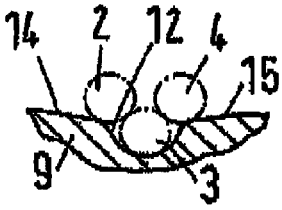
FIGS. 6*a*-6*e* illustrate different rope arrangements on the rope pulley according to FIG. 4.

In FIG. 6*a*, all three ropes 2-4 have a same diameter, e.g., in the order of magnitude of 8 mm.

Figure 6B:
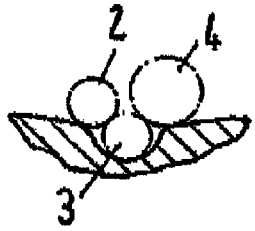
Figure 6C:
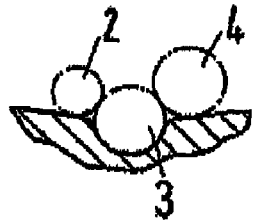
Figure 6D:
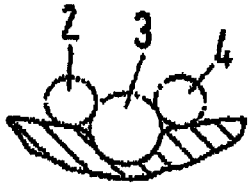
Figure 6E:
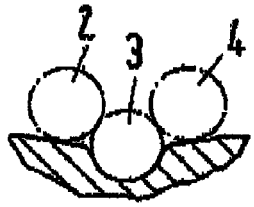

In the embodiment according to FIG. 6*e*, ropes 2-4 can have the same diameter. However, this diameter can be larger than that shown in FIG. 6*a*, e.g., approximately 10 mm. Since leader strip 5, which is not shown in FIG. 6, now no longer needs to be bent over the entire thickness of ropes 2-4,. i.e. their diameter, according to the invention, the diameter of the ropes can be chosen to be larger within certain limits without any fear of additional disturbances through a deformation of the leader strip.

As the exemplary embodiments of FIGS. 6*b*-6*d* show, different rope diameters can also be used together, with preferably two ropes having the same diameter. In FIG. 6*b*, ropes 2 and 3 can have a same diameter, whereas rope 4 can have a larger diameter. In FIG. 6*c*, ropes 3 and 4 have a same diameter, while rope 2 has a smaller diameter. In FIG. 6*d*, ropes 2 and 4 have a same diameter, while rope 3 has a larger diameter. Center rope 3 can projects out of rope groove 12 in the radial direction. By way of example, when rope 3 has a large diameter, e.g., as in FIGS. 6*c*-6*e*, it can project out of rope groove 12 by approximately half of its diameter, while, when rope 3 has a smaller diameter, such as in FIGS. 6*a* and 6*b*, it can project out of rope groove 12 by a smaller part.

Figure 7:
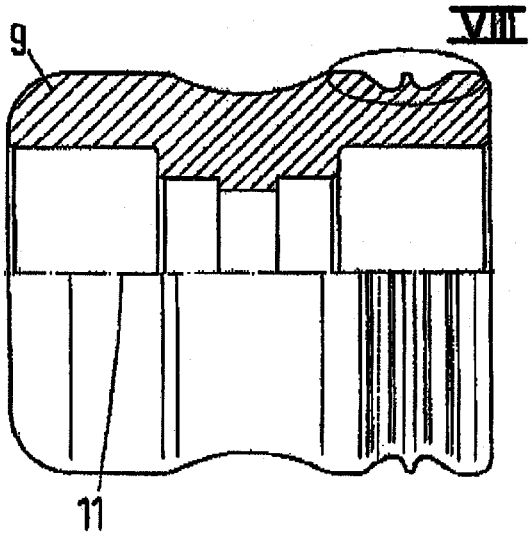
FIG. 7 illustrates a second embodiment of a rope pulley.
Figure 9A:
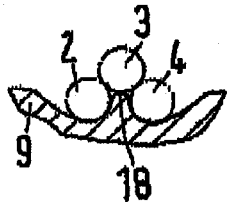
FIGS. 9*a*-9*e* illustrate different rope arrangements of the deflection roller according to FIG. 7.
Figure 9B:
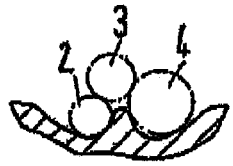
Figure 9C:
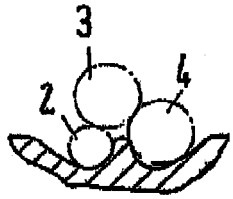
Figure 9D:
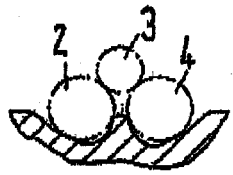
Figure 8:
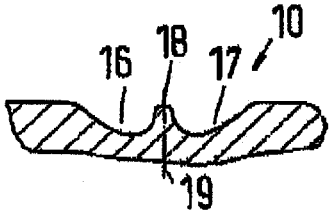
FIG. 8 illustrates an enlarged section VIII depicted in FIG. 7.
Figure 9E:
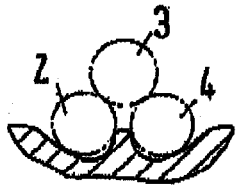

FIGS. 7 through 9 show a second embodiment of a rope pulley, in which the same elements are provided with the same reference numbers.

In a further embodiment of the invention, rope pulley 9 has a rope placement area 10, which is shown in greater detail in FIG. 8. Rope placement area 10' includes two rope grooves 16 and 17 that are separated from one another by a radial projection 18.

Relative to a center 19 of projection 18, rope grooves 16 and 17 are embodied or formed to be symmetrical (mirror image) to one another. However, each individual rope groove 16 and 17 is asymmetrically embodied or formed, i.e., rope grooves 16 and 17 have a smaller radius of curvature in an area of projection 18 than in an area of its axially outer limit. As shown in FIG. 8, radial projection 18 does not project beyond an axial outer limit of rope grooves 16 and 17. Accordingly, it is possible to rout out rope grooves 16 and 17, whereby projection 18 can result without requiring additional material.

FIG. 9 now shows different possibilities of how ropes 2-4 can be arranged. In FIGS. 9*a* and 9*e*, ropes 2-4 can have a same diameter, e.g., a diameter of approximately 8 mm in the embodiment of FIG. 9*a* and a diameter of approximately 10 mm in the embodiment of FIG. 9*e*.

In both cases, it can be seen that a small distance is maintained between outer ropes 2 and 4 by projection 18 so that center rope 3 can enter the recess embodied or formed between ropes 2 and 4.

It can be further noted that outer ropes 2 and 4 can project radially out of rope grooves 16 and 17. Moreover, at least outer ropes 2 and 4 may project beyond projection 18 in the radial direction.

As with the embodiments according to FIGS. 6*b*-6*d*, the three ropes can also have different diameters, however, at least two of the ropes may preferably have a same diameter. In the embodiment according to FIG. 9*b*, ropes 2 and 3 have the same diameter, while rope 4 has a larger diameter. In the embodiment according to FIG. 9*c*, ropes 3 and 4 have the same diameter, while rope 2 has a smaller diameter. In the embodiment according to FIG. 9*d*, ropes 2 and 4 have the same diameter, while rope 3 has a smaller diameter.

Figure 10:
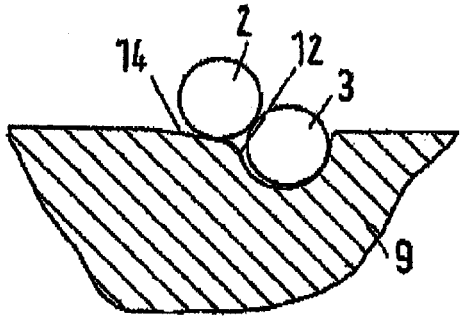
FIG. 10 illustrates a section of a third embodiment of a rope pulley.

FIG. 10 shows a third embodiment of a rope pulley 9 in section. This embodiment can be used for the guidance of two ropes 2 and 3. In accordance with this embodiment, rope 3 can be arranged in rope groove 12 while rope 2 can be arranged on inclined plane 14 to bear against rope 3, i.e., by sliding toward rope 3 to hold leader strip 5 between ropes 2 and 3.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A rope guide arrangement for guiding a leader strip of a material web through a device, comprising:

at least two ropes being arranged offset relative to one another in a first plane defined by a machine direction and a transverse machine direction; and the at least two ropes being arranged offset relative to one another in a second plane oriented at a non-zero angle from the first plane, thereby forming a double offset of the at least two ropes, wherein the double offset is maintained over at least part of a transfer section of the device.

2. The rope guide arrangement in accordance with claim 1, further comprising at least one deflection device including a rope placement area having a contour with different radii parallel to a deflection axis, wherein the at least two ropes are guidable over the at least one deflection device.

3. The rope guide arrangement in accordance with claim 2, wherein the contour comprises at least one rope groove and at least one surface axially outside of the at least one rope groove having a larger radius than the at least one rope groove, and wherein one of the at least two ropes is positionable in the at least one rope groove, and another of the at least two ropes is positionable on the at least one larger radius surface.

4. The rope guide arrangement in accordance with claim 2, wherein the contour comprises at least one rope groove and at least one inclined plane arranged next to the rope groove in an axial direction of the at least one deflection device, and the at least one inclined plane is tilted in a direction towards the rope groove.

5. The rope guide arrangement in accordance with claim 4, wherein the inclined plane has a tilt angle relative to the deflection axis in a range of 5° to 15° .

6. The rope guide arrangement in accordance with claim 2, wherein the contour comprises:

at least two rope grooves arranged next to one another in an axial direction of the at least one deflection device, and a peripheral radial projection arranged to separate the least two rope grooves from each other.

7. The rope guide arrangement in accordance with claim 6, wherein the at least two ropes comprise three ropes and the at least two rope grooves comprises two rope grooves, such that a respective rope is positionable in each rope groove and another rope is positionable in a recess formed between the respective ropes arranged in the two rope grooves.

8. The rope guide arrangement in accordance with claim 7, wherein the another rope is positionable to face the peripheral radial projection.

9. The rope guide arrangement in accordance with claim 7, wherein at least one of the at least two rope grooves is curved more on an axial side facing the peripheral radial projection than on an axial side facing away from the peripheral radial projection.

10. The rope guide arrangement in accordance with claim 7, wherein a radial extension of the peripheral radial projection does not extend beyond a radial extension of an axially outer limit of at least one rope groove facing away from the peripheral radial projection.

11. The rope guide arrangement in accordance with claim 1, wherein the at least two ropes have different diameters.

12. The rope guide arrangement in accordance with claim 11, wherein the at least two ropes comprises three ropes, and a first and second of the three ropes have a same diameter, while a third of the three ropes has a different diameter.

13. The rope guide arrangement in accordance with claim 1, wherein the at least two ropes are arranged to overlap each other in a direction normal to the first plane.

14. The rope guide arrangement in accordance with claim 1, wherein the double offset is maintained over an entirety of the transfer section.

15. A deflection device for a rope guide in a material web production machine, comprising:

a rope placement area having a contoured surface in an axial direction;

the contoured surface comprising at least one rope groove and a structure adjacent the least one rope groove, wherein the contoured surface is structured and arranged to create a clamping force between a first rope positionable in the at least one rope groove and a second rope positionable to face the structure.

16. The deflection device in accordance with claim 15, wherein the structure adjacent the at least one rope groove comprise at least one inclined plane.

17. The deflection device in accordance with claim 15, wherein the at least one rope groove comprises two rope grooves and the structure adjacent the at least one rope groove comprises a peripheral radial projection separating the two rope grooves.

18. The deflection device in accordance with claim 15, wherein the contoured surface is structured and arranged to maintain a positioning between the first and second ropes in which the ropes are offset relative to each other in the axial direction and in a radial direction of the deflection device.

19. The deflection device in accordance with claim 15, wherein the first and second ropes are positionable to at least partially overlap in at least a radial direction.

20. The deflection device in accordance with claim 15, wherein the first and second ropes are offset relative to one another in the axial direction.

21. A method of guiding a leader strip of a material web through a device, comprising:

clamping the leader strip between at least two ropes arranged to be offset relative to one another in a first plane defined by a machine direction and a transverse machine direction and to be offset relative to one another in a second plane oriented at a non-zero angle from the first plane; and guiding the leader strip through the device.

22. The method in accordance with claim 21, further comprising guiding the at least two ropes over a deflection device while maintaining the clamping of the leader strip.

23. The method in accordance with claim 22, wherein the deflection device comprises at least one rope groove and at least one surface axially outside of the at least one rope groove, and the method further comprises:

positioning a first rope of the at least two ropes in the at least one rope groove; and positioning a second rope on the at least one surface axially outside of the at least one rope groove, wherein the at least one surface axially outside of the at least one rope groove is arranged to force the second rope toward the first rope.

24. The method in accordance with claim 22, wherein the deflection device comprises at least two rope grooves separated by a peripheral radial projection, and the method further comprises:

positioning a first rope of the at least two ropes in a first of the at least two rope grooves;

positioning a second rope of the at least two ropes in a second of the at least two rope grooves; and positioning a third rope of the at least two ropes to face the peripheral radial projection, whereby the third rope is forced against both the first and second ropes.

25. The method in accordance with claim 21, wherein the at least two ropes are arranged to overlap each other in a direction normal to the first plane.

26. The method in accordance with claim 21, wherein the double offset is maintained over an entirety of the transfer section.

27. The method in accordance with claim 21, wherein the at least two ropes are arranged to form a double offset that is maintained over at least part of a transfer section of the device.

* * * * *